US006629617B2

(12) United States Patent
Osawa

(10) Patent No.: US 6,629,617 B2
(45) Date of Patent: Oct. 7, 2003

(54) COMMODITY DISPLAY AUXILIARY BASE

(75) Inventor: Shinichi Osawa, Tokyo (JP)

(73) Assignee: Kawajun Co., Ltd., Tokyo (JP)

( * ) Notice: Subject to any disclaimer, the term of this patent is extended or adjusted under 35 U.S.C. 154(b) by 0 days.

(21) Appl. No.: 09/878,342

(22) Filed: Jun. 12, 2001

(65) Prior Publication Data

US 2002/0024273 A1 Feb. 28, 2002

(30) Foreign Application Priority Data

Aug. 22, 2000 (JP) ..... 2000-251076

(51) Int. Cl.[7] ..... A47G 29/087

(52) U.S. Cl. ..... 211/119.003; 211/153; 312/128

(58) Field of Search ..... 312/128, 348.3; 211/153, 119.003, 134, 86.01; 108/147.11, 106, 107, 108

(56) References Cited

U.S. PATENT DOCUMENTS

| | | | | | |
|---|---|---|---|---|---|
| 1,332,087 | A | * | 2/1920 | Vogel | 211/134 |
| 2,889,054 | A | * | 6/1959 | Wheeler | 211/153 |
| 3,481,485 | A | * | 12/1969 | Hess | 108/109 |
| 3,643,607 | A | * | 2/1972 | MacKenzie | 211/153 |
| 3,927,769 | A | * | 12/1975 | Maslow et al. | 211/153 |
| 3,986,462 | A | * | 10/1976 | Heft | 211/153 |
| 4,476,986 | A | * | 10/1984 | Robinson | 211/134 |

FOREIGN PATENT DOCUMENTS

| | | | | |
|---|---|---|---|---|
| FR | 2600873 | * | 1/1988 | 211/86.01 |
| FR | 2651981 | * | 3/1991 | 211/86.01 |
| GB | 2276538 | * | 10/1994 | 211/134 |
| WO | 9107120 | * | 5/1991 | 211/134 |

OTHER PUBLICATIONS

U.S. patent application Ser. No. 09/866,694, May 30, 2001, pending.
U.S. patent application Ser. No. 09/878,342, Jun. 12, 2001, pending.

* cited by examiner

*Primary Examiner*—Lanna Mai
*Assistant Examiner*—Hanh V. Tran
(74) *Attorney, Agent, or Firm*—Oblon, Spivak, McClelland, Maier & Neustadt, P.C.

(57) ABSTRACT

A commodity display auxiliary base includes a shelf plate having a plurality of grooves provided on one side at predetermined intervals and parallel to one another, and of an auxiliary base constituted such that a plate is bent on an arbitrary portion at a predetermined angle and engagement pieces detachably engaged with the grooves of the shelf plate on both ends in a direction perpendicular to the angle thus formed.

7 Claims, 8 Drawing Sheets

Figure2
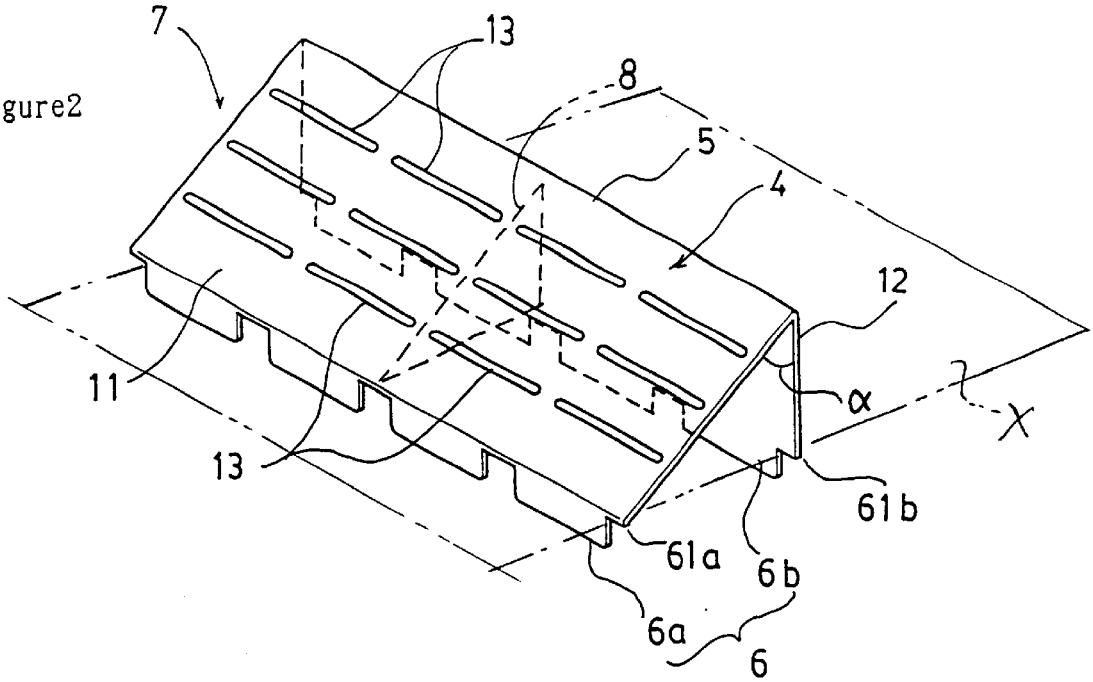
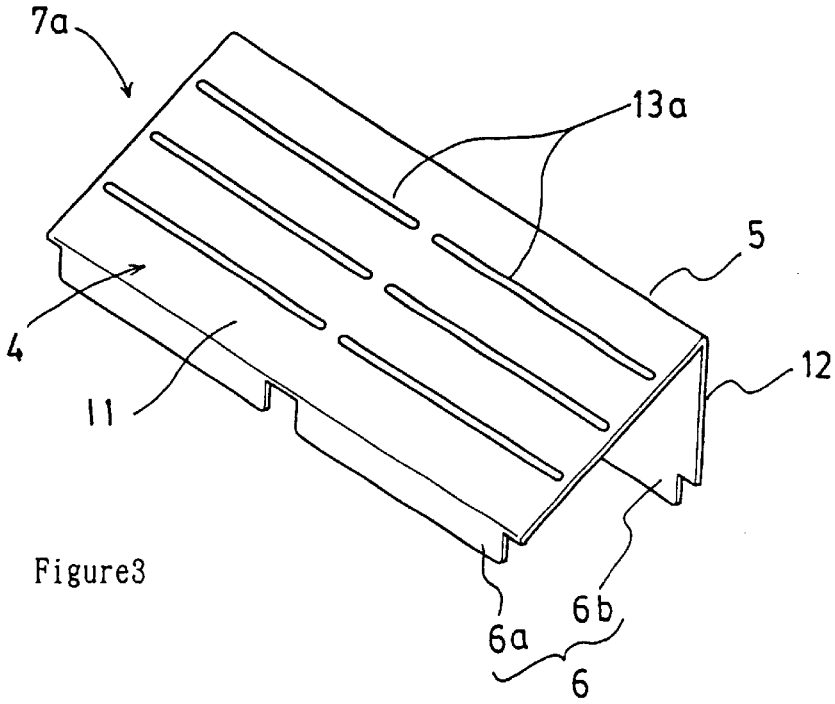
Figure3

COMMODITY DISPLAY AUXILIARY BASE

TECHNICAL FIELD OF THE INVENTION

The present invention relates to a commodity display auxiliary base which is mainly used to display commodities on a commodity display surface in a supermarket, a department store, a specialty store, a convenience store or the like and which can change a display state on the commodity display surface in accordance with the characteristics of the commodities in a diversified manner.

BACKGROUND ART

Conventionally, to display commodities on a commodity display surface in a supermarket, a department store, a specialty store, a convenience store or the like, the following simplest methods are adopted. (1) Partitions are provided in the horizontal space of the commodity display surface, commodities are arranged according to the partitions or the commodities are arranged in box members and the box members are put in the horizontal space. (2) Since customers find it difficult to look at commodities put on an inner part in the horizontal space or particularly the lowest stage of the horizontal space of the commodity display surface and to take out the commodities, a base is disposed in the inner part, display plates are put on the base to provide an inclined display shelf and partitions are provided on the inclined display shelf. Then, commodities are arranged according to the partitions or commodities are arranged in box members and the box members are mounted on the inclined display shelf. (3) As a commodity display auxiliary base used on the lowest stage of a commodity display surface, a commodity display auxiliary base dedicated to oblique display and having platforms or inclined surfaces provided in advance. Commodities are directly arranged on the platforms or inclined surfaces, or the commodities are arranged in box members and the box members are mounted on the platforms or the inclined surfaces. (4) An angle selection type commodity display auxiliary base capable of selecting whether to be set horizontally or obliquely and capable of selecting an inclined angle is provided on the commodity display surface. Partitions are provided on the commodity display auxiliary base and commodities are arranged according to the partitions, or the commodities are arranged in box members and the box members are mounted on the angle selection type commodity display auxiliary base.

Commodity display methods for displaying commodities in the supermarket and the like as described above often influence the sales of the commodities. For that reason, besides the above-stated methods, various devices are proposed and various other methods are adopted. Basically, however, any of these methods is intended to partition commodities by partition plates or box members and display the commodities in the various types of display spaces of an inclined display shelf or a commodity display auxiliary base dedicated to oblique display or of an angle selection type.

According to the commodity display methods (1) and (2) stated above, it is necessary to prepare partition plates and box members in accordance with the horizontal space or inclined display shelf. In many cases, these partition plates and box members cannot be used at all except that they can be used in the corresponding horizontal space and inclined display shelf. Even if they can be used, they are often unsuited eventually for the commodity display which attaches great importance to how the commodities appear attractive. Due to this, various shapes of partition plates and box members and various sizes of the respective shapes thereof are required. Every time the display is changed, some partition plates and box members become unnecessary or new partition plates and box members need to be purchased. Besides, since it is considered that the partition plates and the box members which have become unnecessary may be reused, it is highly likely that they cannot be disposed with but stored, with the result that a storage space is required.

Moreover, according to the commodity display methods utilizing commodity display auxiliary base dedicated to oblique display (3) and that of a horizontal/inclined angle selection type (4), platforms or inclined surfaces are provided in advance or angle can be selected. Due to this, the commodity display auxiliary bases are easier to handle and the disadvantages of the commodity display methods (1) and (2) stated above can be advantageously reduced. Recently, the display tends to be frequently changed because of the diversification of commodities and intensified competition. In case of the commodity display auxiliary base dedicated to oblique display, however, it is difficult to change the platforms or inclined surfaces disposed in advance. In case of the angle selection type commodity display auxiliary base, too, even if the angle can be changed, it is difficult to emphasize the presence of the commodities or add volume to the commodities. As a result, it is impossible to satisfactorily deal with the change of the display, and various shapes of commodity display auxiliary bases dedicated to oblique display and of an angle selection type are required. Consequently, the commodity display methods (3) and (4) have the same disadvantages as those of the methods (1) and (2) described above.

It is, therefore, an object of the present invention to provide a commodity display auxiliary base which can deal with the diversification of commodities and the frequent changes of display, which can decrease the probability that the components of the commodity display auxiliary base become unnecessary every time the display of commodities is changed to thereby make it less necessary to buy new components and which can reduce a storage space, while being provided with fewer components.

DISCLOSURE OF THE INVENTION

Under these circumstances, the inventor devoted himself to studies. As a result, the inventor the following discovery. If a commodity display auxiliary base is constituted out of a shelf plate having a plurality of grooves provided on one side at predetermined intervals and parallel to one another, and of auxiliary bases each provided by bending a plate on an arbitrary portion at a predetermined angle and having a plurality of engagement pieces provided on the both ends in the longitudinal direction of the bent plate and detachably engaged with the grooves of the shelf plate, and a plurality of auxiliary bases are fitted into the grooves of the shelf plate, then it is possible to create various types of outlooks convenient to the display of commodities on the shelf plate, to display various types of commodities and to make it almost unnecessary to prepare spared components. Finally, the present invention has been completed.

That is to say, the present invention (1) provides a commodity display auxiliary base, disposed on a commodity display surface, for setting a commodity display state in order, characterized by comprising a shelf plate having a plurality of grooves provided on one side at predetermined intervals and parallel to one another; and an auxiliary base constituted such that a plate is bent on an arbitrary portion at a predetermined angle, an engagement pieces detachably engaged with the grooves of the shelf plate are provided on both ends of the plate in longitudinal direction, a plurality of grooves detachably engaging the engagement pieces are provided on one of or both of planes formed by bending the plate, and engagement pieces of another auxiliary base can be engaged with the plurality of grooves.

Also, the present invention (2) provides a commodity display auxiliary base, disposed on a commodity display surface, for setting a commodity display state in order, characterized by comprising: a shelf plate having a plurality of grooves provided on one side at predetermined intervals and parallel to one another; and an auxiliary base constituted such that a plate is bent on an arbitrary portion at a predetermined angle, engagement pieces detachably engaged with the grooves of the shelf plate are provided on portions, on which a virtual plane perpendicular to one of planes forming the predetermined angle crosses the two planes, in a direction perpendicular to the virtual plane, a plurality of grooves detachably engaging the engagement pieces are provided one of or both of the planes formed by bending the plate and engagement pieces of other auxiliary bases can be engaged with the plurality of grooves.

Further, the present invention (3) provides a commodity display auxiliary base characterized in that one of the planes formed with the angle of the auxiliary base serving as a border is wider than the other plane.

Additionally, the present invention (4) provides a commodity display auxiliary base characterized by further comprising a commodity partition plate detachably attached to the grooves of the shelf plate and the grooves of the auxiliary base.

BRIEF DESCRIPTION OF THE DRAWINGS

FIGS. 2 to 5 are perspective views showing an auxiliary base which is one of the constituent elements of the commodity display auxiliary base shown in FIG. 1;

DETAILED DESCRIPTION OF THE INVENTION

Figure 1:
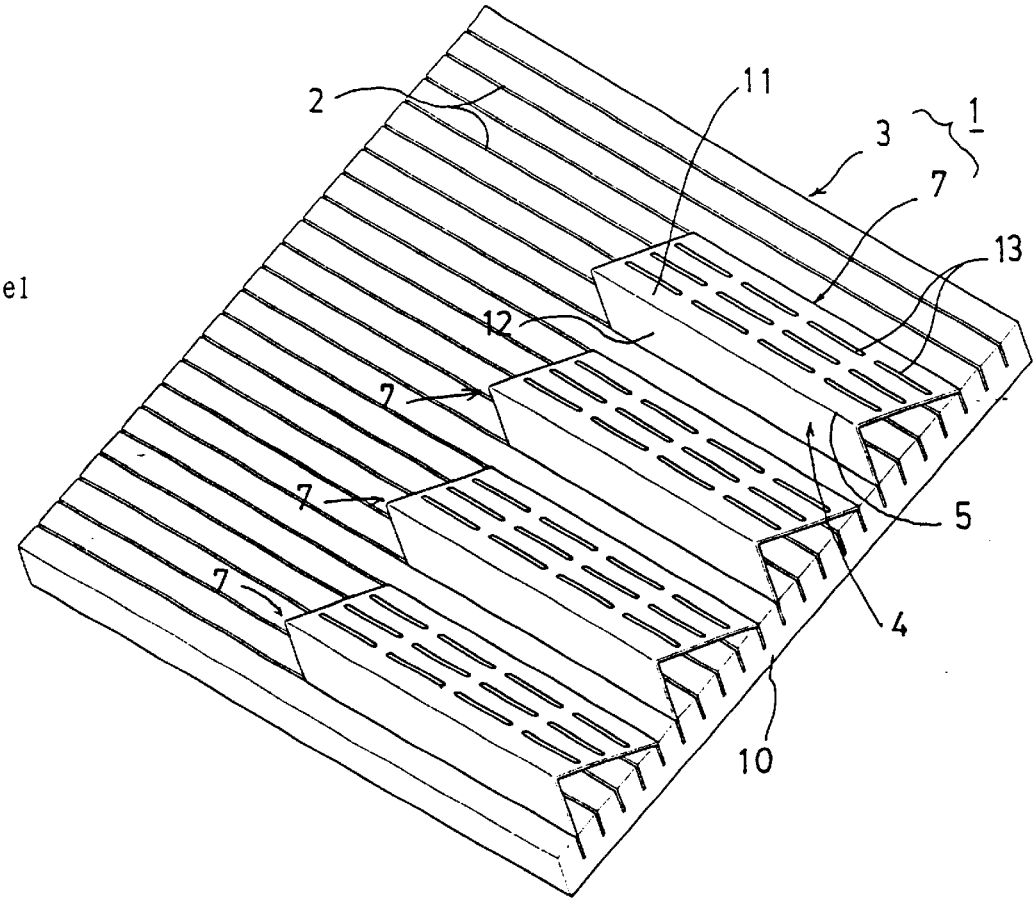
FIG. 1 is a perspective view showing a commodity display auxiliary base in one embodiment according to the present invention.

A commodity display auxiliary base in one embodiment according to the present invention will be described hereinafter in detail with reference to FIGS. 1 to 14. FIG. 1 is a perspective view showing a commodity display auxiliary base in one embodiment according to the present invention. FIGS. 2 to 5 are perspective views showing an auxiliary base which is one of the constituent elements of the commodity display auxiliary base shown in FIG. 1. In these figures, the commodity display auxiliary base 1 is disposed on a commodity display surface to set a commodity display state in order. The commodity display auxiliary base 1 consists of a shelf plate 3 having a plurality of grooves 2 provided on one side at predetermined intervals in parallel to one another and auxiliary bases 7 each formed by bending a plate 4 on an arbitrary portion at a predetermined angle and having engagement pieces 6 provided on the longitudinal both ends of the plate 4 and detachably engaged with the grooves of the shelf plate 3, respectively.

The shelf plate 3 has a flat plate 10 having a predetermined dimension and provided with the grooves 2 at predetermined intervals, e.g., equidistantly and parallel to one another. The width and depth of each groove 2 are set so as to engage the engagement piece 6 of the auxiliary base 7 and to detach and attach the engagement piece 6. The dimension of the shelf plate 3 is set arbitrarily so as to be able to deal with various commodity display places. The shelf plate 3 is used while being attached horizontally or obliquely to the commodity display surface. The material of the shelf plate 3 is not limited.

Since a plurality of the auxiliary bases 7 are used to be disposed on the shelf plate 3, the auxiliary bases 7 have predetermined dimensions smaller than that of the shelf plate 3. As a preferred embodiment, the plate 4 of each of these auxiliary bases 7 is bent at a sharp angle ($\alpha$) on a portion on which one plane is wider than another plane to thereby provide a wide plane 11 and a narrow plane 12, and a rib 8 supporting the both planes 11 and 12 is provided. Engagement pieces 6*a* are provided on the end of the wide plane 11 and engagement pieces 6*b* are provided on the end of the narrow plane 12. The engagement pieces 6*a* are provided at an angle (180 degree—sharp angle ($\alpha$)) with respect to the wide plane 11. The engagement pieces 6*a* and 6*b* are set so that the plane distances of the pieces 6*a* and 6*b* are equal and that the pieces 6*a* and 6*b* can be smoothly engaged with the grooves 2 of the shelf plate 3, respectively. In other words, the engagement pieces 6*a* and 6*b* are provided on portions 61*a* and 61*b* on which a virtual plane X perpendicular to the narrow plane 12 crosses the wide plane 11 and the narrow plane 12, in a direction perpendicular to the virtual plane X. Further, one or more grooves 13 same in width as the grooves 2 of the shelf plate 3 are provided on the wide plane 11 of the auxiliary base 7 at predetermined intervals, e.g., equidistantly and parallel to one another. In the example of FIG. 2, there are three columns of grooves 13 and each column is quartered. Due to this, the engagement pieces 6*a* and 6*b* are also quartered so as to be able to be engaged with the respective grooves 13. Also, it is not always necessary to provide grooves 13 in the auxiliary base 7. However,if no grooves 13 are provided, methods of using the commodity display auxiliary base shown in FIGS. 9 to 11, 13 and 14 becomes unavailable. It is also possible to provide grooves 13 in the narrow plane 12.

Figure 4:
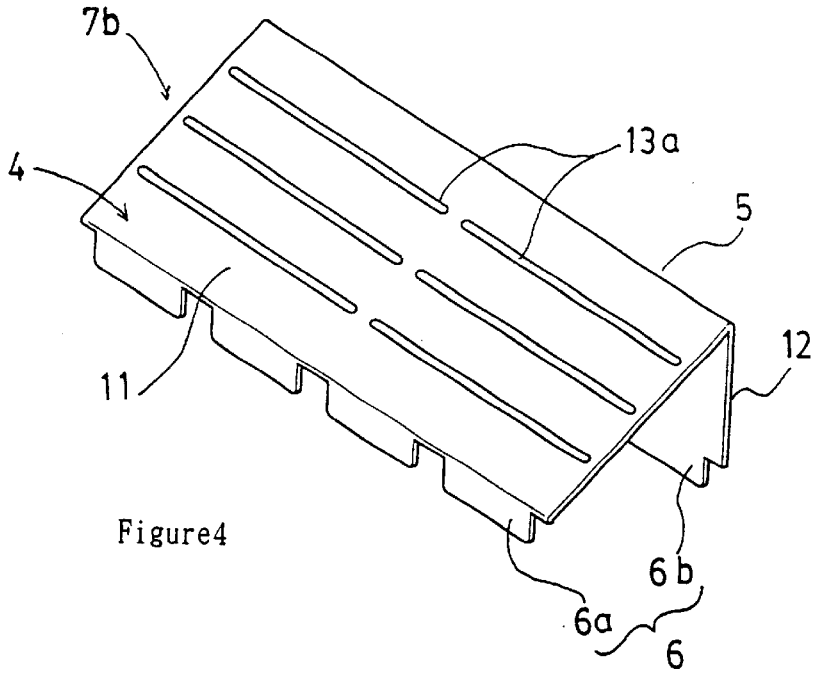
Figure 5:
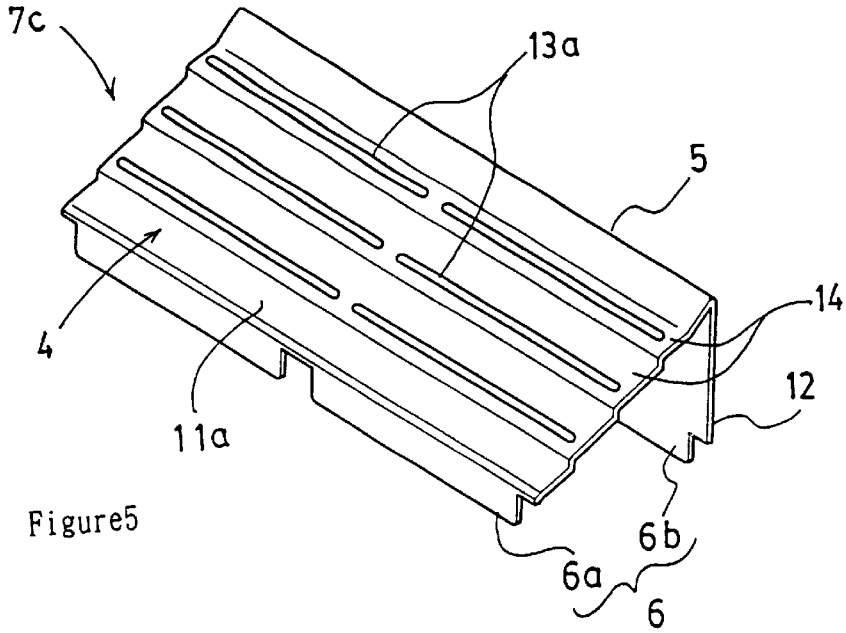

FIG. 3 shows an auxiliary base 7*a* in another embodiment. The auxiliary base 7*a* in FIG. 3 differs from the auxiliary base 7 in FIG. 2 in that each column of grooves 13*a* is halved and the engagement pieces 6*a* and 6*b* are halved so as to be able to be engaged with the respective grooves 13 accordingly. FIG. 4 shows yet another embodiment of an auxiliary base 7*b*. The auxiliary base 7*b* in FIG. 4 differs from the auxiliary base 7 in FIG. 2 in that while each column of grooves 13*a* are halved, the engagement pieces 6*a* and 6*b* are not halved to allow the engagement pieces to be engaged with the respective grooves 13*a* but quartered. FIG. 5 shows yet another embodiment of an auxiliary base 7*c*. The auxiliary base 7*c* in FIG. 5 differs from the auxiliary base 7*a* in FIG. 3 in that a small step 14 is provided on the wide plane 11*a* per column of grooves 13*a*. Since the remaining constituent elements of these auxiliary bases 7*a*, 7*b* and 7*c* are the same as those of the auxiliary base 7 shown in FIG. 2, they are denoted by the same reference symbols and no description will be given thereto.

As can be seen from the above, the shapes of the wide plane 11 and the narrow plane 12 are not specially limited and may be, for example, a flat plate, a corrugated flat plate or a stepped flat plate. Further, the number of portions on which the grooves 13 are disposed are not specially limited. For example, appropriate combinations of the number of columns in a range of two to five and the number of divided grooves in a range of two to five can be made.

Figure 6:
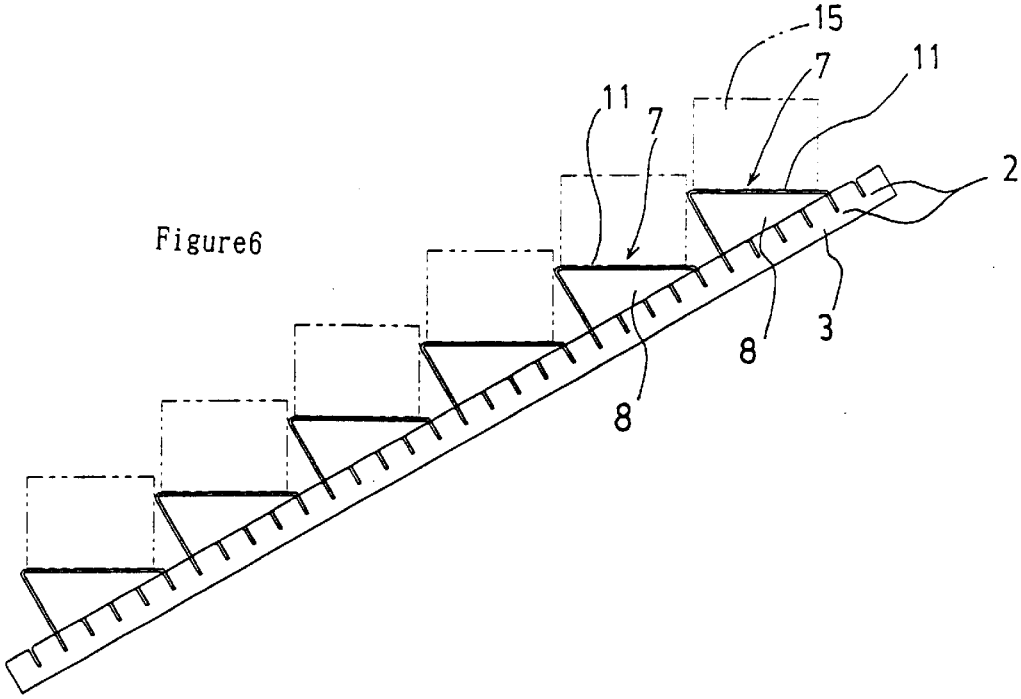
FIG. 6 is a cross-sectional view showing a state in which the commodity display auxiliary base in one embodiment according to the present invention is used.

Next, the method of using the commodity display auxiliary base 1 constituted as stated above will be described in detail with reference to the drawings. First, the commodity display auxiliary base 1 is used in a manner as shown in FIG. 6. Namely, FIG. 6 shows a case where the shelf plate 3 is inclined using a base or the like and disposed on the commodity display surface, the auxiliary bases 7, 7*a*, 7*b* or 7*c* (which will be referred to as auxiliary bases 7 or the like hereinafter) are engaged with the grooves 2 of the shelf plate 3 so that the wide planes 11 of the auxiliary bases 7 or the like become horizontal, many narrow platforms are formed and stable commodities 15 are displayed on the many platforms.

Figure 7:
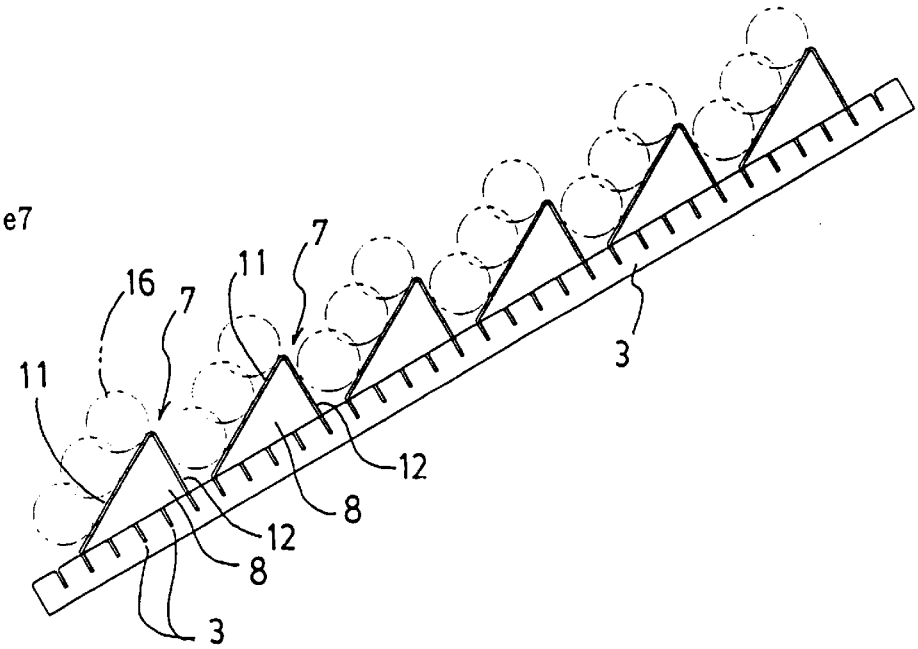
FIGS. 7 to 11 are cross-sectional views showing another state in which the commodity display auxiliary base in the embodiment according to the present invention is used.

Next, the commodity display auxiliary base 1 is used in a manner as shown in FIG. 7. Namely, FIG. 7 shows a case where the auxiliary bases 7 or the like are engaged with the grooves 2 of the shelf plate 3 which is disposed obliquely in an opposite state to that of FIG. 6, many narrow platforms are formed with the narrow planes 12 of the front auxiliary bases 7 or the like used as commodity drop preventing walls and with the wide planes 11 of the rear auxiliary bases 7 or the like used as commodity mounting surfaces, and unstable commodities 16 are displayed on the many platforms.

The methods of using the commodity display auxiliary base 1 shown in FIGS. 6 and 7 are the most basic methods.

Figure 8:
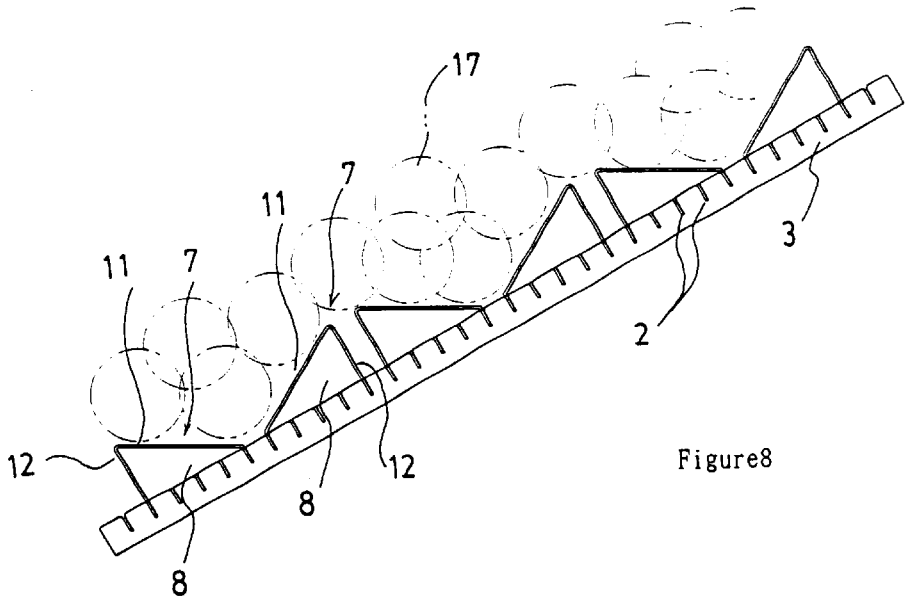

Further, the commodity display auxiliary base 1 is used in a manner as shown in FIG. 8. Namely, FIG. 8 shows a case where the shelf plate 3 is disposed obliquely on the commodity display surface, the auxiliary bases 7 or the like are engaged with the grooves 2 of the shelf plate 3 alternately in the manners shown in FIGS. 6 and 7, many platforms are formed with the wide planes 11 of the auxiliary bases 7 or the like used as horizontal commodity mounting surfaces and inclined walls for emphasizing the presence of the commodities and for making the commodities appear to increase volume, and relatively large, unstable commodities 17 are displayed on the many platforms.

Figure 9:
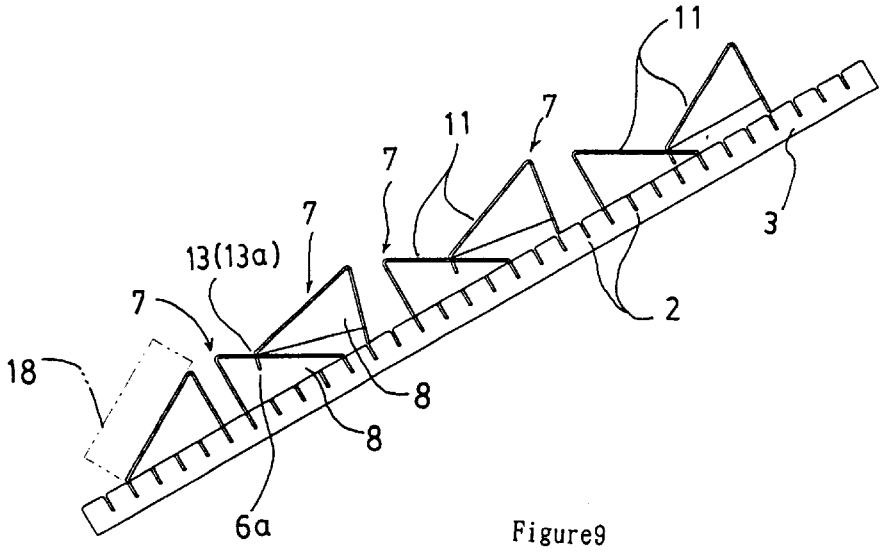

Moreover, the commodity display auxiliary base 1 is used in a manner as shown in FIG. 9. Namely, FIG. 9 shows a case where the shelf plate 3 is disposed obliquely on the commodity display surface, the auxiliary bases 7 or the like are engaged with the grooves 2 of the shelf plate 3 at the lowest positions as in the case of FIG. 7, the auxiliary bases 7 or the like are sequentially engaged thereon as in the case of FIG. 6, other auxiliary bases 7 or the like are engaged with or mounted on the grooves 13 (13*a*) of the auxiliary bases 7 or the like engaged as shown in FIG. 6 and on the shelf plate 3, many platforms are formed with the auxiliary bases 7 or the like used as horizontal commodity mounting surfaces and inclined walls for emphasizing the presence of the commodities and for making the commodities appear increase volume, and stable commodities 18 are displayed on the many platforms. In case of FIG. 9, the engagement pieces 6*a* of the other auxiliary bases 7 or the like are engaged with the grooves 13 (13*a*) of the three columns of the auxiliary bases 7 or the like while engagement positions are sequentially shifted downward in ascending order and commodity mounting surfaces formed out of the wide planes 11 of the both types of auxiliary bases 7 or the like are made wider accordingly.

Figure 10:
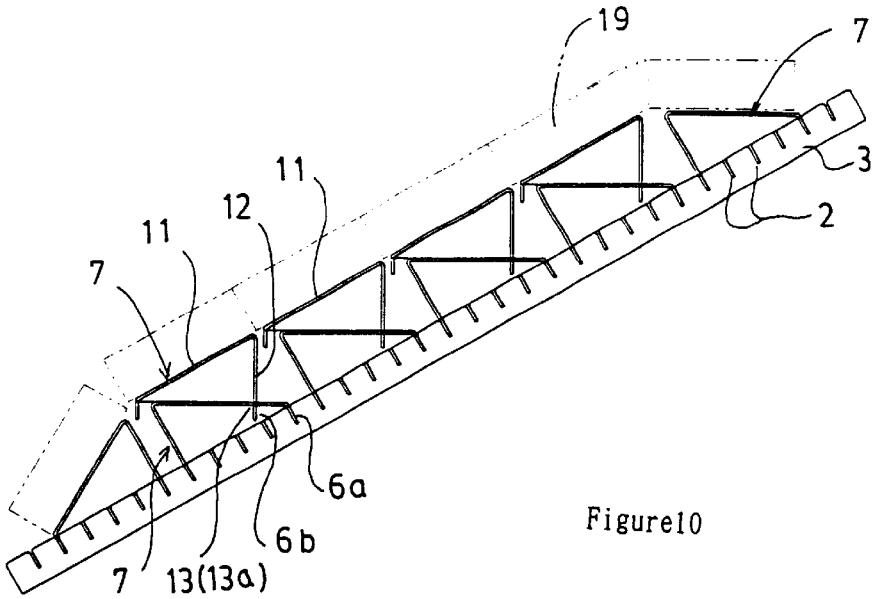

In addition, the commodity display auxiliary base 1 is used in a manner as shown in FIG. 10. Namely, FIG. 10 shows a case where the shelf plate 3 is disposed obliquely on the commodity display surface, the auxiliary bases 7 or the like are engaged with the grooves 2 of the shelf plate 3 at the lowest positions as in the case of FIG. 7, the auxiliary bases 7 or the like are sequentially engaged thereon as in the case of FIG. 6, the engagement pieces 6*b* of other auxiliary bases 7 or the like are engaged with the grooves 13 (13*a*) close to the engagement pieces 6*a* of the auxiliary bases 7 or the like engaged in the manner as shown in FIG. 6, the wide planes 11 of the other auxiliary bases 7 or the like are set to have almost the same inclination as that of the shelf plate 3, the wide planes 11 of the other auxiliary bases 7 or the like are used mainly as inclined commodity mounting surfaces and horizontal commodity mounting surfaces for emphasizing the presence of the commodities and for making the commodities appear to increase volume, and stable commodities 19 are displayed on these commodity mounting surfaces. It is also possible to engage yet other auxiliary bases 7 or the like with the other auxiliary bases 7 or the like to provide a structure of three or more stages.

Figure 11:
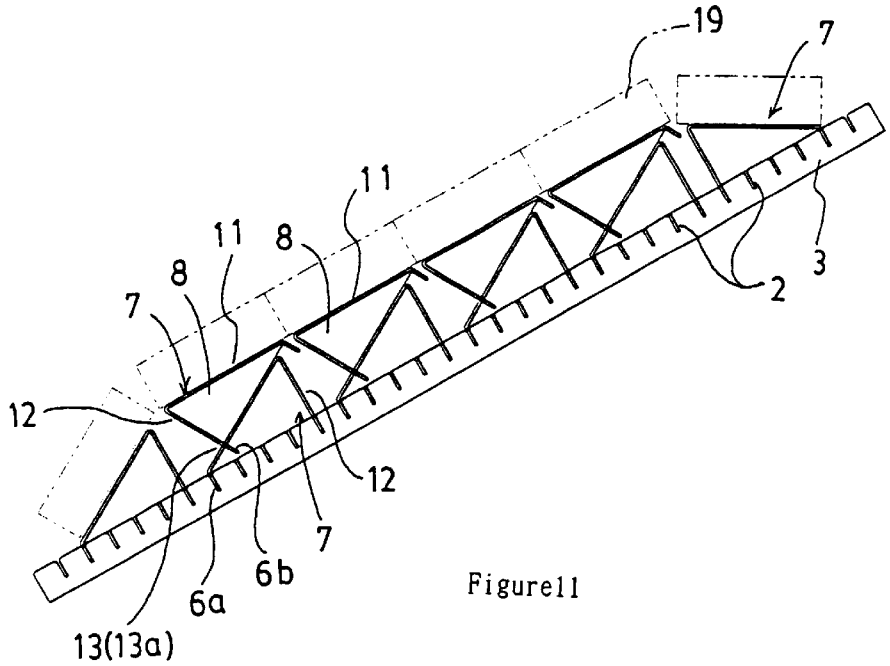

Further, even if the state in which the commodity display auxiliary base 1 is used as shown in FIG. 10 is changed to a state as shown in FIG. 11, i.e., a state in which the engagement pieces 6*b* of other auxiliary bases 7 or the like are engaged with the grooves 13 (13*a*) close to the engagement pieces 6*a* of the auxiliary bases 7 or the like engaged in the manner shown in FIG. 7, the wide planes 11 of the other auxiliary bases 7 or the like can be set to have almost the same inclination as that of the shelf plate 3 and the commodities can appear voluminous.

Figure 12:
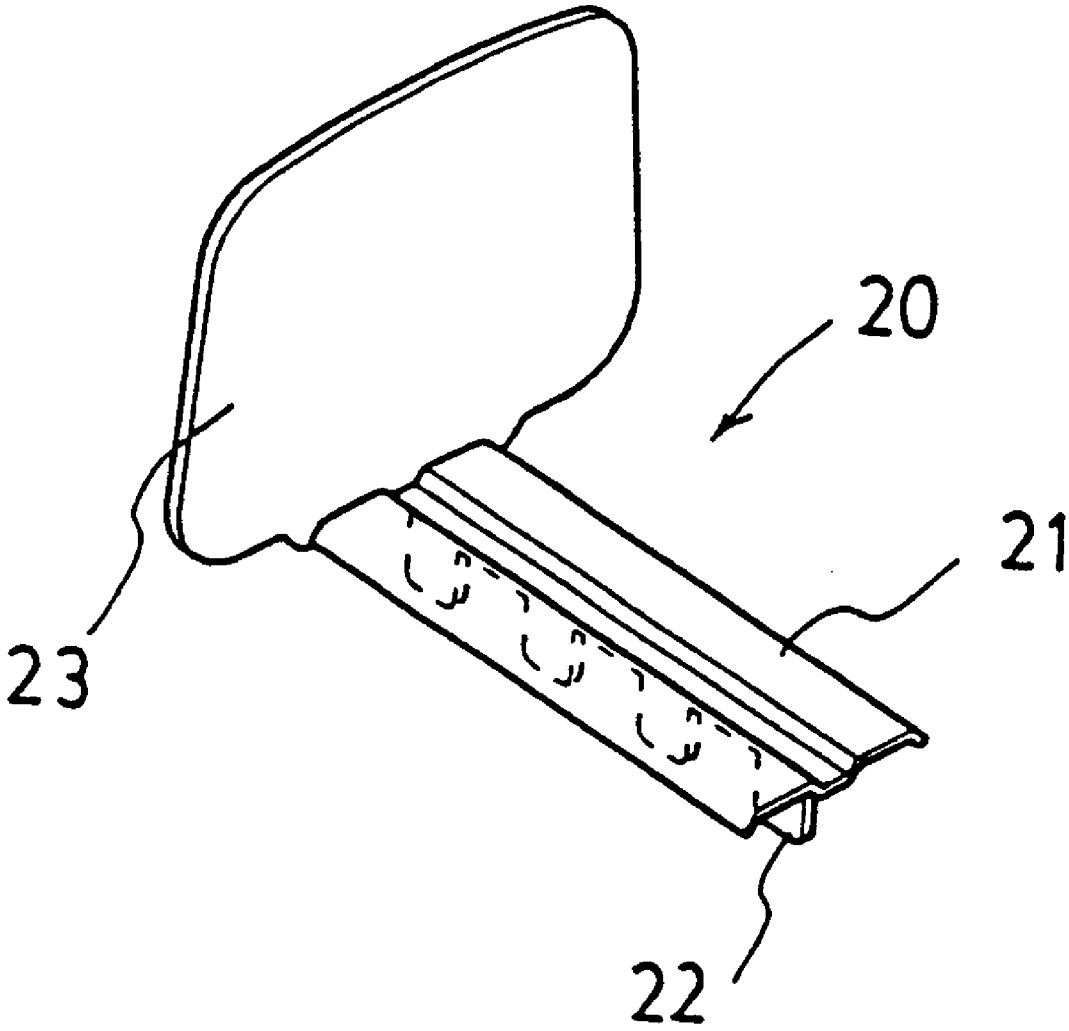
FIG. 12 is a perspective view showing a commodity partition plate which is one of the constituent elements of the commodity display auxiliary base in one embodiment according to the present invention.
Figure 13:
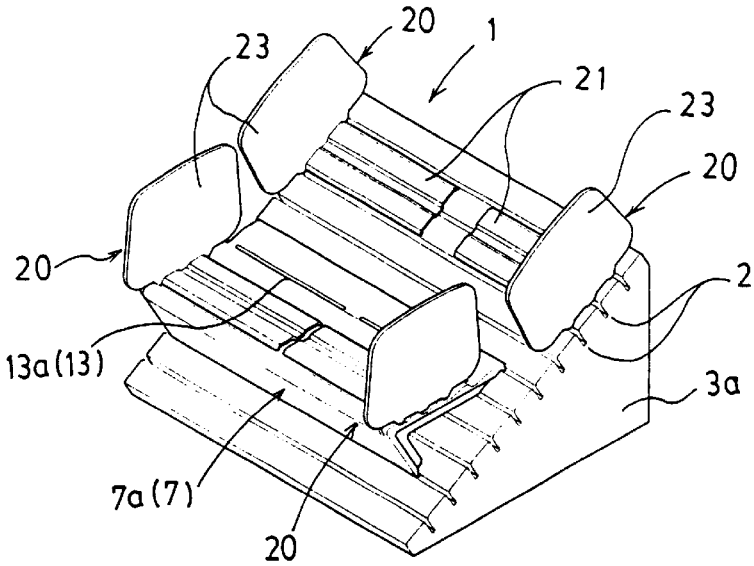
FIGS. 13 and 14 are perspective view showing a state in which the commodity partition plate which is one of the constituent elements of the commodity display auxiliary base in the embodiment according to the present invention, is used.
Figure 14:
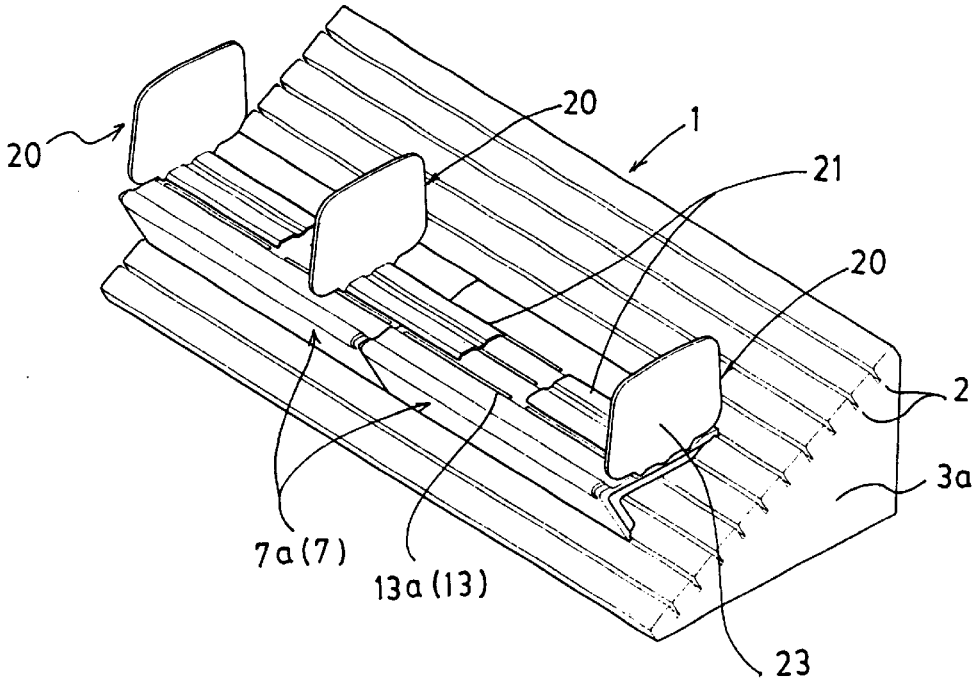

FIG. 12 shows a commodity partition plate 20 detachably provided on a plurality of grooves 2 of the shelf plate 3 and a plurality of grooves 13 (13*a*) of the auxiliary bases 7 or the like. This commodity partition plate 20 is constituted such that an engagement piece 22 is provided on the lower surface of the plate 21 and that a partition plate 23 is provided on one end of the plate 21. The engagement piece 22 is formed in accordance with the shapes of the grooves 2 and 13 (13*a*). Alternatively, the commodity partition plate 20 may be provided with partition plates 23 on the both ends of the plate 21, respectively. As shown in FIG. 13, the commodity partition plate 20 may be engaged with either the groove 2 of the shelf plate 3*a* of an inclined structure or a plurality of grooves 13*a* (13) of the auxiliary base 7*a* (7). Moreover, as shown in FIG. 14, various methods may be adopted including creating two partitioned spaces on a plurality of auxiliary bases 7*a* (7) by using three partition plates 20.

As stated above, the commodity display auxiliary base 1 can be conveniently, variously used in accordance with the characteristics of commodities, the state of a place in which the base 1 is disposed and the like.

The embodiments of the present invention have been described so far. The concrete constitution of the present invention should not be, however, limited to these embodiments. Any changes and modification which do not depart from the content of the present invention are included in the scope of the present invention.

Industrial Applicability

As described in detail so far, according to the inventions (1) and (2) of the present invention, by disposing the shelf plate at an arbitrary angle using a base or the like and engaging a plurality of auxiliary bases with the grooves of the shelf plate in various directions, it is possible to create various outlooks convenient to the display of commodities on the shelf plate and commodities can be displayed in various manners. For example, it is possible to engage and stack arbitrary stages of other, one or more auxiliary bases on one or more auxiliary bases on the shelf plate and to display the commodities variously, accordingly. Therefore, the inventions (1) and (2) can advantageously deal with the diversification of commodities and the frequent changes of display, decrease a probability that components become unnecessary every time the display is changed, make it less necessary to buy new components and reduce a storage space, while being provided with fewer components.

According to the invention (3) of the present invention, there are two planes different in width with an angle as a border and commodities can be displayed in various manners, accordingly. Therefore, the invention (3) has the same advantages as those of the inventions (1) and (2). Besides, the invention (3) can advantageously increase display options and display commodities in manners rich in variety.

According to the invention (4) of the present invention, a commodity partition plate is detachably provided on a plurality of grooves of the shelf plate and a plurality of grooves of the auxiliary bases, thereby making it possible to partition commodities. The invention (4), therefore, has the same advantages as those of the preceding inventions. Besides, the invention (4) can advantageously ensure and facilitate partitioning the commodities.

What is claimed is:

1. A commodity display auxiliary base, disposed on a commodity display surface, for setting a commodity display state in order, comprising:

a shelf plate having a plurality of grooves provided on one side at predetermined intervals and parallel to one another; and an auxiliary base constituted such that a plate is bent on an arbitrary portion at a predetermined angle along a line perpendicular to a longitudinal direction to form opposing sides, and that engagement pieces detachably engaged with the grooves of said shelf plate are provided on both opposing sides of the plate and extend in the longitudinal direction.

2. A commodity display auxiliary base, disposed on a commodity display surface, for setting a commodity display state in order, comprising:

a shelf plate having a plurality of grooves provided on one side at predetermined intervals and parallel to one another; and an auxiliary base constituted such that a plate is bent on an arbitrary portion at a predetermined angle to form opposing sides, and that engagement pieces detachably engaged with the grooves of said shelf plate extend in a direction perpendicular to a plane X, the plane X being perpendicular to one of the opposing sides forming the predetermined angle and intersecting said two opposing sides at locations where the engagement pieces meet the opposing sides.

3. A commodity display auxiliary base according to claim 1 or 2, wherein one of the opposing sides formed with the angle of said auxiliary base serving as a border is wider than the other opposing side.

4. A commodity display auxiliary base, disposed on a commodity display surface, for setting a commodity display state in order, comprising:

a shelf plate having a plurality of grooves provided on one side at predetermined intervals and parallel to one another; and an auxiliary base constituted such that a plate is bent on an arbitrary portion at a predetermined angle along a line perpendicular to a longitudinal direction to form opposing sides, engagement pieces detachably engaged with the grooves of said shelf plate are provided on both opposing sides of the plate and extend in the longitudinal direction, at least one groove detachably engaging at least one of said engagement pieces is provided on one of or both of the opposing sides formed by bending the plate, and at least one of engagement pieces of another auxiliary base can be engaged with the at least one groove.

5. A commodity display auxiliary base, disposed on a commodity display surface, for setting a commodity display state in order, comprising:

a shelf plate having a plurality of grooves provided on one side at predetermined intervals and parallel to one another; and an auxiliary base constituted such that a plate is bent on an arbitrary portion at a predetermined angle to form opposing sides, engagement pieces detachably engaged with the grooves of said shelf plate extend in a direction perpendicular to a plane X, the plane X being perpendicular to one of the opposing sides forming the predetermined angle and intersecting said two opposing sides at locations where the engagement pieces meet the opposing sides, at least one groove detachably engaging at least one of said engagement pieces is provided on one of or both of the opposing sides formed by bending the plate, and at least one of engagement pieces of other auxiliary bases can be engaged with the at least one groove.

6. A commodity display auxiliary base according to claim 4 or 5, wherein one of the opposing sides formed with the angle of said auxiliary base serving as a border is wider than the other opposing side.

7. A commodity display auxiliary base according to claim 4 or 5, further comprising:

a commodity partition plate detachably attached to the plurality of grooves of said shelf plate and the at least one groove of said auxiliary base by an engagement piece formed in accordance with a shape of each of the grooves of said shelf plate and a shape of the groove of said auxiliary base, each of the grooves of said shelf plate being equal in width to the groove of said auxiliary base.

* * * * *